United States Patent [19]

Harada et al.

[11] 4,167,718

[45] Sep. 11, 1979

[54] DIES SET FOR MAGNETIZING OUTER SURFACE OF MAGNETIC COLUMN

[75] Inventors: Hideki Harada, Urawa; Keitaro Yamashita, Kamisatomachi; Katsunobu Yamamoto, Kumagaya, all of Japan

[73] Assignee: Hitachi Metals, Ltd., Tokyo, Japan

[21] Appl. No.: 838,452

[22] Filed: Oct. 3, 1977

[51] Int. Cl.[2] ..... H01F 13/00

[52] U.S. Cl. ..... 335/284; 361/143; 118/658

[58] Field of Search ..... 335/284; 361/143; 118/658; 29/607

[56] References Cited

U.S. PATENT DOCUMENTS

| | | | |
|---|---|---|---|
| 3,158,797 | 11/1964 | Andrews | 335/284 |
| 3,402,698 | 5/1967 | Motoki | 118/658 |
| 3,455,276 | 5/1967 | Anderson | 118/658 |
| 3,828,730 | 5/1972 | Keitarou | 118/658 |
| 3,952,701 | 11/1974 | Keitarou | 118/658 |

FOREIGN PATENT DOCUMENTS

| | | | |
|---|---|---|---|
| 5114800 | 7/1974 | Japan | 335/284 |

*Primary Examiner*—R. N. Envall, Jr.
*Attorney, Agent, or Firm*—Finnegan, Henderson, Farabow & Garrett

[57] ABSTRACT

Disclosed is an improved dies set for magnetizing a cylindrical or columnar magnet adapted for use in an electrostatic developing apparatus of magnetic-brush developing type. The dies set is intended for imparting axially extending and circumferentially alternating magnetic poles to the periphery of the cylindrical columnar permanent magnet. The magnetizing dies set of the invention has a specific pattern of magnetic pole arrangement for rendering the distribution of magnetic attracting force, which is to be permanently applied to the peripheral surface of the columnar magnet in the magnetic developer, so that the attracting force becomes as uniform as possible, over the entire periphery of a shell surrounding the permanent magnet.

4 Claims, 8 Drawing Figures

DIES SET FOR MAGNETIZING OUTER SURFACE OF MAGNETIC COLUMN

LIST OF PRIOR ART REFERENCES (37 CFR 1.56 (a))

The following references are cited to show the state of the art:

Japanese Utility Model Laid-Open No. Sho 51-14800, Keitarou Yamashita et al., July 22, 1974

U.S. Pat. No. 3,455,276, Glenn R. Anderson, May 23, 1967

U.S. Pat. No. 3,402,698, Motoki Kojima et al., May 26, 1967

U.S. Pat. No. 3,828,730, Keitarou Yamashita et al., May 16, 1972

U.S. Pat. No. 3,952,701, Keitarou Yamashita et al., Nov. 5, 1974

BACKGROUND OF THE INVENTION

The present invention relates to a dies set for magnetizing the outer surface of a columnar magnet adapted for use in electrostatic developing apparatus of magnetic brush developing type and, more particularly, to a dies set for imparting a plurality of axially extending poles to a cylindrical surface of a columnar magnet which is generally referred to as a magnetic roll.

Developers conventionally used for developing latent images on an electrostatic latent-image carrier such as a photoconductive body are classified into dry type developer consisting of dry powders, and wet type developer consisting of developing powders dispersed in a suitable solvent. From another point of view, the developers are classified into bicomponent developer consisting of two components of magnetic carrier and toner particles, and unicomponent developer in which magnetic particles are included in the toner particles.

Also, the developing methods, i.e., the methods for depositing the developing particles on a latent image carried by an electrostatic latent image carrier, are generally classified into cascade type and magnetic brush type. In the past, the cascade type developing method had been widely used. However, due to the so-called edge effect or fringing effect, which disadvantageously causes an insufficient developing at the central portion of the region to be developed, and due to other disadvantages inherent in the cascade type method, the magnetic brush type developing method has been getting popular in recent years.

In the developing apparatus of the magnetic brush type, the developer particles are conveyed to the region of a latent image on a carrier, in accordance with the rotation of a developing roll. The developer particles then form a protruding mass in the form of a brush, in the area close to the electrostatic latent image, by the attracting force caused by a permanent magnet incorporated in the developing roll. The developer particles are deposited on the latent image to render the latter visible, as the image is rubbed by the brush-like mass of developing particles, as a result of the rotation of the developing roll or of the movement of the image itself. The developing roll consists of a columnar permanent magnet provided with a supporting or rotary shaft, and a cylindrical shell provided to coaxially enclose the magnet for free relative rotary motion. A plurality of poles are formed on the surface of the magnet to extend in the axial direction of these magnets. It has been confirmed that the formation of the magnetic brush is greatly affected by the pattern of arrangement of these poles.

The present invention aims at providing a dies set for a magnetizing device capable of magnetizing the columnar magnets in such a manner as to impart a uniform distribution of particle-attracting force to the surface of the cylindrical shell, even though the magnet is rotating.

To this end, according to the invention, there is provided a dies set having dies made of soft iron in which is formed a through bore for receiving a cylindrical columnar permanent magnet material to be magnetized. A plurality of grooves are formed in the wall of the through bore to extend in the axial direction of the magnet. Each groove is separated from each adjacent groove by an axially extending protrusion which forms a magnetic pole of the dies. The top surfaces of these magnetic poles are therefore put in the close proximity of the peripheral surface of the magnet material. Magnetizing coils are received by the grooves in such a manner that the magnetizing currents in coils of adjacent grooves run in the opposite axial directions.

For obtaining a regular pattern repetition of circumferentially alternating magnetic poles along the surface of the cylindrical columnar permanent magnet, all of the magnetic poles protruding from the peripheral wall of the through bore of the dies set preferably have an equal circumferential breadth. Also, the grooves in the wall of the through bore should have an equal breadth.

At the same time, it is highly preferred that the grooves are fully filled with the magnetizing coils as uniformly as possible, so as to obtain a monotonical distribution of magnetic field between the adjacent magnetic poles.

Further, the breadth of the magnetic pole of the dies set is preferably selected to be 0.16 to 0.5 times that of the grooves which are separated by the magnetic pole.

Although not exclusive, the dies set is preferably divided into a plurality of segments, along plane or planes which passes the central axis of the columnar magnet to be magnetized when it is in therein, for an easier magnetizing operation.

The above and other objects, as well as advantageous features, of the invention will become clear from the following description of preferred embodiments taken in conjunction with the attached drawings in which:

DESCRIPTION OF THE PREFERRED EMBODIMENTS

Figure 1:
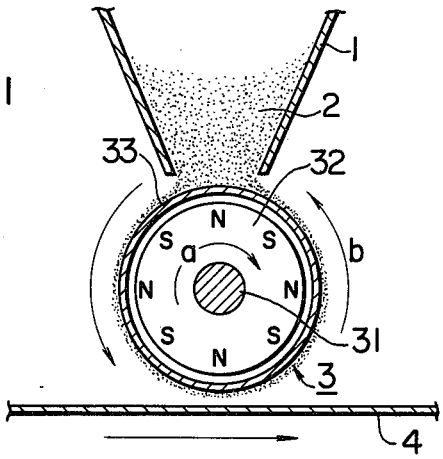
FIG. 1 is a cross-sectional view of an essential part of a typical conventional magnetic-brush-type developing apparatus.

Before turning to the description of the invention, a description will be made as to the conventional developing apparatus, in order to clarify its drawbacks to be overcome by the present invention. Referring to FIG. 1 showing a cross-section of a typical electrostatic developing apparatus, developer 2 stored in a hopper 1 contains, as mentioned before, magnetic particles and, therefore, is attracted and deposited onto the peripheral surface of a developing roll 3 disposed beneath the hopper 1.

Figure 2:
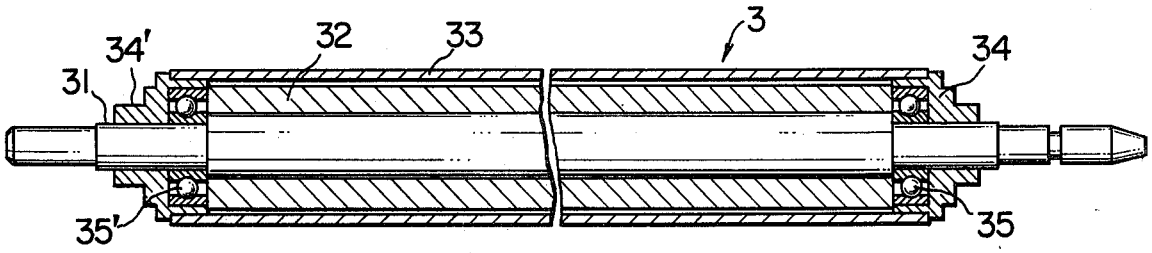
FIG. 2 is a longitudinal sectional view of a columnar magnet roll.

As will be seen from FIG. 2, the developing roll 3 has a cylindrical or columnar permanent magnet 32 coaxially mounted on a steel shaft 31, and a coaxial cylindrical shell 33 having an inner diameter slightly larger than the outer diameter of the permanent magnet 32. The shell 33 is fitted onto flanges 34, 34' at respective ends, which are supported on the steel shaft 31 through bearings 35, 35', for free rotation relative to the permanent magnet 32. The shell 33 is made of a non-magnetic material such as aluminum, plastics or the like, so as to allow the magnetic flux produced by the permanent magnet 32 to exert its influence on the surface of the developing roll 3.

The permanent magnet 32 has a plurality of magnetic poles N and S, each extending in the axial direction of the magnet, which poles are distributed over the periphery of the magnet at a substantially constant circumferential pitch.

The permanent magnet practically has a diameter of 25 to 75 mm. For successfully forming 4 to 10 magnetic poles on the permanent magnet of above stated size, the magnet is preferably a ceramic magnet, rather than alnico-type magnet, typically a Ba ferrite magnet.

In the developing apparatus shown in FIG. 1, the shell 33 is fixed, while the permanent magnet 32 is allowed to rotate in the direction of an arrow a.

As the permanent magnet 32 rotates, the developer 2 deposited on the shell 33 is attracted by the magnetic force of the permanent magnet 32 to move in the direction of an arrow b. Consequently, magnetic brushes are formed with the developer 2 on the peripheral surface of the shell 33 at portions of the latter, along the magnetic fluxes formed by these poles N and S. At the same time, the developer 2 is attracted to the shell 33, forming bridges extending over portions of the shell 33 between the neighbouring poles N and S along the magnetic flux directed from N to S. The particles of developer thus attracting to the periphery of the shell 33 are then brought to confront the support 4 on which the electrostatic latent image is held, so as to rub the image. Consequently, parts of developer particles are transferred to the latent image to render the image visible.

There is an intricate mutual interference between the attracting force exerted by the magnet to attract the magnetic developer toward the developing roll and a electrostatic attraction force exerted on the same magnetic developer by the electrostatic latent image. Particularly, in the developing appratus in which a permanent magnet is rotated within a stationary non-magnetic sleeve or shell, the magnetic attracting force at the developing position fluctuates cyclically, often resulting in an irregular development due to the cyclic fluctuation of the magnetic force.

Under this circumstance, the present invention is intended for an improved magnetizing method and apparatus, capable of providing a developing apparatus which is more free from the undesirable irregular development, even in case of the rotary permanent magnet type which are obtained through our intense study and analysis of the fluctuation of the magnetic attracting force.

Figure 7:
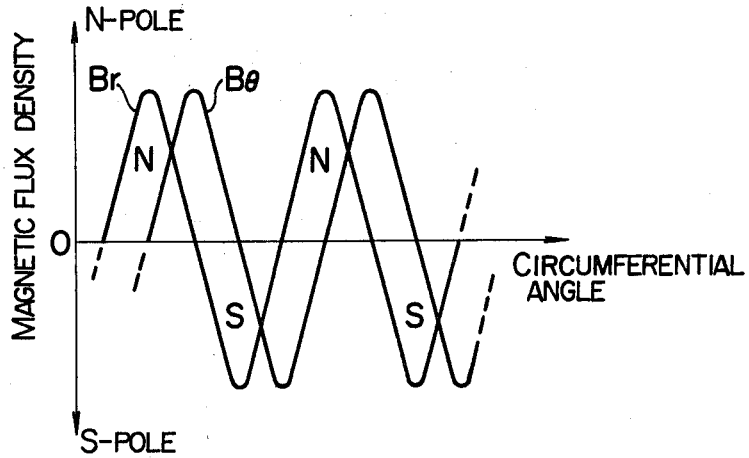
FIG. 7 shows the magnetic flux distribution on the surface of the columnar magnet, magnetized by the dies set in accordance with the invention.

An observation of circumferential distribution of magnetic flux density caused by a magnetic roll, as shown in FIG. 7 will enable one to see that the radial component Br of the magnetic flux is thickest at the portions just above the poles, while the tangential component $B\theta$ of the magnetic flux is thickest at midways of adjacent poles. Although the component $B\theta$ shows a steeper peak, these components in general draw sinous curves along the periphery of the columnar magnet.

For instance, assuming here that a cylindrical columnar magnet of isotropic Ba ferrite having a diameter of 30 mm, magnetized with eight poles on the surface thereof, is coupled with a non-magnetic shell having an outer diameter of 32 mm, and the maximum magnetic flux density is kept as high as 750 G. An experiment was conducted to investigate the distribution of attracting force exerted on the magnetic developer by the magnetic roll having the described magnetic flux distribution.

Figure 8:
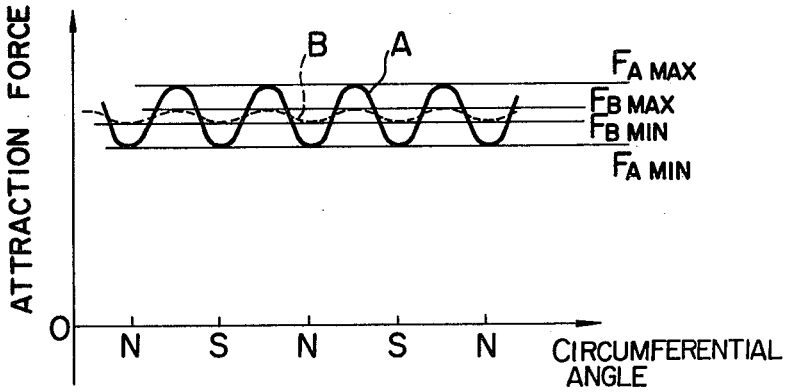
FIG. 8 is a graphical representation of a distribution of attracting force on the surface of the columnar magnet.

Since it is almost impossible to actually measure the distribution of the magnetic attracting force with the magnetic developer of a particle size of 10 microns, an iron spherical body or ball of 1 mm dia. was used instead of the magnetic developer. The magnetic attracting force acting on the iron ball was measured at various positions on the non-magnetic shell of 32 mm dia. coupled with the magnet of 30 mm dia. As a result of the test, it has proved that the magnetic attracting force varies substantially following the curve as shown in FIG. 8, assuming the maximum value at midways between adjacent pair of poles and the minimum value at portions just above the poles. The ratio of variation Fmax/Fmin of the magnetic attracting force was observed to be as high as 1.4.

This means that the attracting force exerted by the magnet is less influential at portions just above the poles than at midways between poles, so that the magnetic developer is apter to be transferred to the latent image at portions just above the poles, thus causing the aforementioned unfavourable uneven development.

Accordingly, the inventors have made theoretical studies and experiments to find out the pattern of magnetic flux distribution which would minimize the fluctuation of the magnetic attracting force.

On the other hand, it has been known that the magnetic attracting force F exerted on a magnetic particle in a magnetic field is in direct proportion to the absolute value of the product of magnetic field intensity and the gradient of the magnetic field. In the magnetic structure of the kind described, having a plurality of magnetic poles disposed on a cylindrical magnetic roll of tens of millimeters dia., a compound force of forces produced by the radial component Br and the tangential component $B\theta$ of the magnetic flux density are applied to the magnetic particle.

Thus, the magnetic attracting force F applied to the magnetic particle is represented by the following equation of:

$$F \alpha Br \frac{\partial Br}{\partial r} + B\theta \frac{\partial B\theta}{\partial r}$$

where, F represents the magnetic attracting force, Br represents the radial component of the magnetic flux density, Bθ represents the tangential component of the magnetic flux density, and r represents the position of the magnetic particle on an assumed or imaginary polar coordinate.

It will be seen that the magnetic attracting force exerted on the position where the magnetic developer is transferred toward the latent-image, becomes constant over the entire periphery of the developing roll, when the value given by the above equation is kept constant. As a result of an intense study on various patterns of magnetic flux distribution, the present inventors have reached a conclusion that a triangular pattern is of magnetic flux distribution is one which can satisfy the above stated requirement.

Magnetizing means for imparting such a triangular distribution pattern of magnetic flux to the cylindrical columnar magnet has not been available nor proposed up to now.

It is to be noted here that the present inventors have succeeded in developing magnetizing means which can provide the above stated pattern of magnetic flux distribution, as will be described hereinafter.

Figure 3:
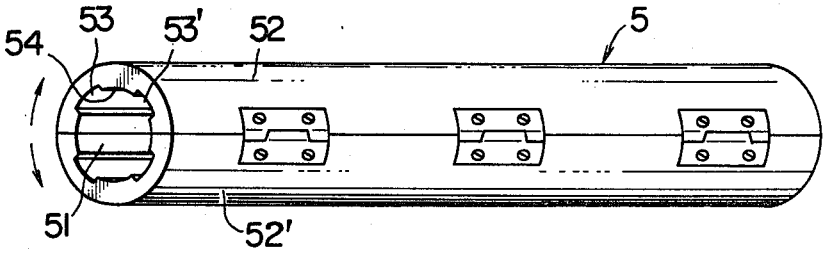
FIG. 3 is a perspective view of an iron core of the dies set in accordance with the invention.

Referring to FIG. 3, a magnetizing dies set 5 in accordance with the invention has a dies portion provided with a through bore 51 for receiving a cylindrical columnar permanent magnet to be magnetized. The dies set is split into two segments 52, 52', along a plane which passes through the central axis line of the permanent magnet disposed therein. Grooves 53, 53' are formed in each of the inner surfaces of the segments 52, 52' defining the through bore 51. The grooves 53, 53' in each segment extend in the axial direction of the magnet, and are separated by an axially extending protrusion 54 which forms a magnetic pole 54.

Figure 4:
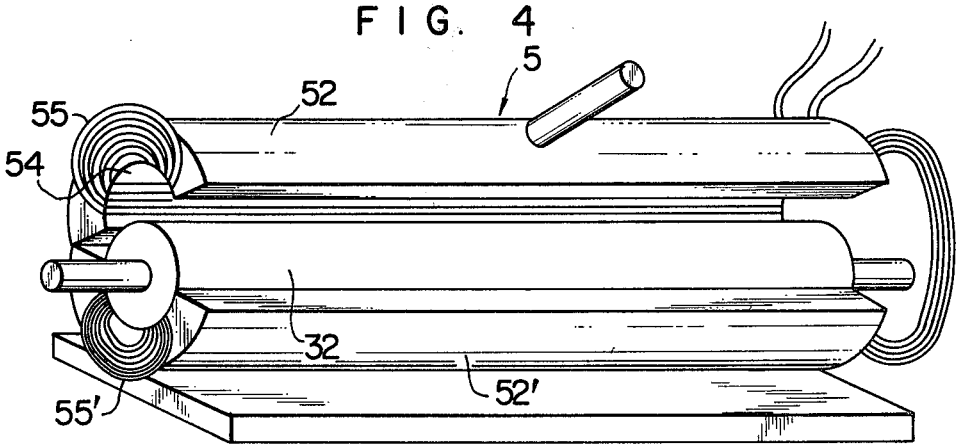
FIG. 4 is an illustration of the dies set of the invention in the state of use.

Grooves 53, 53' receive respective side portions of a coil winding 55 in such a manner that the electric currents through all the coils of the winding received by the same groove run in the same direction. At the same time, as will be seen from FIG. 4, the arrangement is such that the currents through coil windings 55, 55' received by adjacent grooves 53, 53' run in the opposite directions.

A magnet material is put in the through bore 51 of the dies set 5, and a D.C. power is applied between the leads of the coil windings. Consequently, the material is magnetized permanently, to become a permanent magnet 32 having magnetic poles appearing in its peripheral surface.

Figure 5:
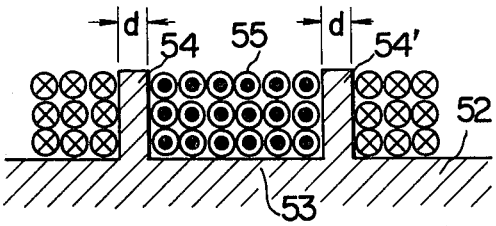
FIG. 5 is an magnified sectional view of the dies set as shown in FIGS. 3 and 4, showing the inner structure of the latter.
Figure 6:
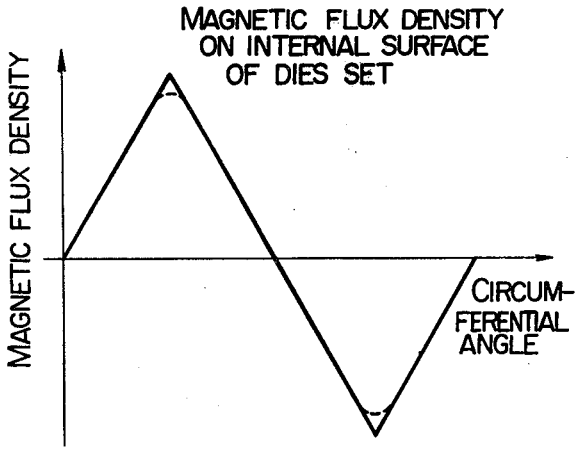
FIG. 6 is a graphical representation of the magnetic flux distribution over the dies set.

The breadth d of the magnetic pole 54 of the dies set 5 is selected as small as possible, and coil windings 55 are fitted uniformly as shown in FIG. 5. Then, a magnetic flux density distribution results between the adjacent magnetic poles 54, 54', having a peak of N pole located at the breadthwise center of the magnetic pole 54 and a peak of S pole located at the breadthwise center of the adjacent magnetic pole 54' and is continuously linear between the adjacent poles, as shown in FIG. 6.

When the peripheral surface of a cylindrical columnar magnet made of Ba ferrite is magnetized by means of a dies set having a construction as stated above, magnetic poles of the columnar magnet are formed at portions thereof corresponding to the magnetic poles of the dies set, so as to exhibit a distribution of radial component of magnetic flux density Br as shown in FIG. 7. The tangential component Bθ of the magnetic flux is lagged behind the radial component Br by a quarter wave length.

A cylindrical columnar magnet of 28 mm dia. can have 4 to 10 magnetic poles representing the substantially isoscele or isosceles triangular pattern of distribution of magnetic flux density as shown in FIG. 7, when the breadth d of the magnetic pole 54 of the dies set 5 is selected to be 3 mm or smaller.

A dies having above described construction was prepared, to have a number of turns of coil, in each groove, of 4 to 5 turns/cm and a resistance of coil of less than 0.4 Ω. The dies set was connected to a D.C. power source of capacitor charging and discharging type. An isotropic Ba ferrite cylindrical columnar magnet material was put in the dies set and kept under the influence of a magnetic field of an intensity of 5000 to 7000 Oe given by the magnetizing current of 1000 to 5000 A, so as to impart 8 magnetic poles to the peripheral surface of the cylindrical columnar magnet.

The magnetized magnet was then assembled with a shell of 32 mm dia. to form a developing roll.

The broken line curve B of FIG. 8 shows the circumferential distribution of the magnetic attracting force over the peripheral surface of the shell. The ratio Fmax/Fmin of variation of attracting force was observed to be as low as 1.04.

This developing roll was then incorporated in an electrophotographic copying machine which employs a developer of particle size of about 10 microns for a test development.

The resulting hard copy was developed highly uniformly or evenly, to such an extent as could never be expected from the conventional developing apparatus.

It has also proved that the thinner the magnetic developer on the shell gets, the more remarkable the advantage of the invention becomes.

Having described the invention with specific reference to an illustrated embodiment, it is to be noted here that the described embodiment is not exclusive, and various changes and modifications may be imparted thereto without departing from the scope of the invention which is delimited solely by the appended claims.

What is claimed is:

1. A structure of dies set for magnetizing the cylindrical surface of a columnar magnet, the structure comprising:

a plurality of axially extending and circumferentially disposed magnetic poles defining at their radially inner ends a through-bore for receiving a columnar permanent magnet material to be magnetized, said inner ends being located in close proximity to the outer cylindrical surface of said columnar permanent magnet material received by said through-bore; and means for generating a triangular magnetic flux distribution having its peak value for each pole at the center of the magnetic pole and a continuously linear wave form between the adjacent poles.

2. The structure of dies set as set forth in claim 1, wherein each of said grooves is fully filled with said coil winding.

3. The structure of dies set as claimed in claim 1, wherein the circumferential breadth of each of said magnetic poles falls within a range of between 0.16 to 0.5 times that of said groove.

4. The structure as set forth in claim 1, wherein said means for generating includes coil windings received in each groove formed between the adjacent magnetic poles.

* * * * *